United States Patent [19]

Kudirka

[11] 4,408,198

[45] Oct. 4, 1983

[54] VIDEO CHARACTER GENERATOR

[75] Inventor: Paul E. Kudirka, Acton, Mass.

[73] Assignee: Shintron Company, Inc., Cambridge, Mass.

[21] Appl. No.: 302,160

[22] Filed: Sep. 14, 1981

[51] Int. Cl.[3] ..... G09G 1/16

[52] U.S. Cl. ..... 340/729; 340/730; 340/748

[58] Field of Search ..... 340/729, 730

[56] References Cited

U.S. PATENT DOCUMENTS

| | | | |
|---|---|---|---|
| 3,781,849 | 12/1973 | Baron et al. | 340/730 |
| 3,918,039 | 11/1975 | Clark | 340/730 |
| 3,984,828 | 10/1976 | Beyers | 340/730 |
| 4,186,393 | 1/1980 | Leventer | 340/729 |

*Primary Examiner*—David L. Trafton
*Attorney, Agent, or Firm*—Paul E. Kudirka

[57] ABSTRACT

Digital apparatus for generating video characters with various kinds of edging is disclosed. The apparatus employs a plurality of digital delay registers which are used to generate a replica of the video information which is delayed by a preselected number of scan lines. The video information together with the delayed signals produced by the delay registers are provided to a pair of shift registers which generate fixed background patterns depending on the kind of edge information which is selected and a character body signal. The background pattern and the character body signal are then combined to produce the final video character output.

10 Claims, 9 Drawing Figures

HORIZONTAL SYNC.
401
CLOCK GENERATOR
404
CLOCK SIGNAL
405
CHARACTER GATE INFO.
406
TO DELAYS AND SHIFT REGISTERS
DIGITAL VIDEO SIGNAL
402
I SCAN LINE DELAY
408
I SCAN LINE DELAY
415
409
407
420
425
426
CHARACTER PATTERN GENERATOR
435
BACKGROUND PATTERN GENERATOR
430
CHARACTER SIGNAL
437
BACKGROUND SIGNAL
436
465
FORMAT GENERATOR
450
460
FORMAT INFORMATION
403
COMPOSITE VIDEO SIGNAL TO KEYER
451
452

VIDEO CHARACTER GENERATOR

FIELD OF THE INVENTION

The present invention relates to an apparatus for generating characters for video display and, in particular, to apparatus which generates signals for the display of specialized characters with enhanced edge information.

BACKGROUND OF THE INVENTION

Prior art systems which are capable of generating characters having video enhanced edges have been of both analog and digital types.

The analog devices have usually not functioned satisfactorily because they have been composed of analog delay lines and other components which are subject to drift and noise problems. In addition, such systems have not been capable of providing edge information on the entire periphery of the character and therefore have been unable to generate the complex video character and edge information required by modern-day display devices.

The digital prior art approaches which have been capable of providing the necessary edge information around the entire periphery of the character have had other problems in that they are generally complex and costly. In addition, with these systems it is often difficult to change basic character formats without a substantial redesign and rewiring of the circuitry and without increasing the number of integrated circuit devices used in the system for generating the edge information.

One prior art digital circuit capable of generating enhanced video edges is described in U.S. Pat. No. 3,918,039. However, this circuit uses a plurality of shift registers and a complex gating arrangement to generate the required information. It is therefore difficult to change the format of the basic character without a rewiring of the system.

Another similar digital edge enhancement circuit is shown in U.S. Pat. No. 4,186,393. This circuit uses a simplified gate arrangement to generate the edge information, but still utilizes a group of shift registers to delay the incoming video information for the generation of appropriate information. Therefore, a change in the basic character format, such as an increase in the width of the character requires an increased number of shift registers.

It is therefore an object of the present invention to provide a simplied, all digital video character enchancement system.

An additional object of the invention is the generation of video character information having all-around edge information.

A further object of the invention is the generation of video character and edge information utilizing simplified, generator circuitry which does not require an increase in the number of shift registers if the basic character format is changed.

SUMMARY OF THE INVENTION

The foregoing problems are solved and the objects are realized in one illustrative embodiment of the invention in which electronic signals representing a composite video character with edge information are generated by two separate pattern generators—one generator produces a background pattern and the other produces a character body signal. The outputs of the generators are then combined to produce the composite output. Specifically, digitized character information representing a video character without edge information is provided to several digital delay circuits which produce identical copies of the information delayed by time intervals equal to an integral number of scan lines. The outputs of the delay circuits are used to control a generator which produces two fixed patterns to provide a character background signal. In addition, selected outputs from the delay circuits are provided to another pattern generator which provides character body information. The character background and body information is ANDed together to produce the final composite output consisting of a central character body with the background providing the edge information.

More specifically, the generator which provides the background information consists of a shift register which is loaded with a fixed pattern of digital "1"s and "0"s when certain portions of the digitized character information appear at the outputs of the delay circuits. The pattern of "1"s and "0"s in the shift register is shifted when other portions of the digitized character information are present at the output of the delay circuits. Character body information is generated by another shift register by shifting delayed digitized character information through the shift register and deriving the body information from selected stages.

DETAILED DESCRIPTION OF THE INVENTION

A typical, modern video display unit consists of a cathode ray tube which produces an electron beam that illuminates a small portion of the tube face and two analog sweep generators which sweep the beam in horizontal and vertical directions. In order to provide a stable picture, the operation of the sweep generators is controlled by synchronization circuitry. This circuitry produces a horizontal synchronization pulse which synchronizes the operation of the horizontal sweep circuit and a vertical synchronization pulse which synchronizes the operation of the vertical sweep circuitry. The operation of the entire display is generally synchronized to the horizontal synchronization pulse which is generated by a crystal controlled oscillator or other stable means to produce a jitter-free picture.

In order to display characters such as letters and numbers on the cathode ray screen, a specialized circuit known as a digital character generator is used. To sychronize this circuit the time duration during which one horizontal scan line occurs is arbitrarily divided up into a number of equal intervals called picture elements or "pixels." A typical number of pixels per scan line is 256. In addition, a scan line interval is also divided into a number of character block intervals, each consisting of an equal number of pixels (typically, sixteen). The digital character generator is controlled by the synchronization circuits to produce a sequence of digital information consisting of "1"s and "0"s or digital "bits", one bit per pixel. The bit information in a sequence of pixels is provided to the video monitor as the spot on the cathode ray tube is swept across the screen by the sychronized sweep circuits. When the bit information is in one state, for example a "1", the cathode ray tube beam is turned "on" to produce a bright spot on the screen. When the bit information is in the other state (a "0") the beam is turned "off" to produce a dark area on the screen.

Figure 1:
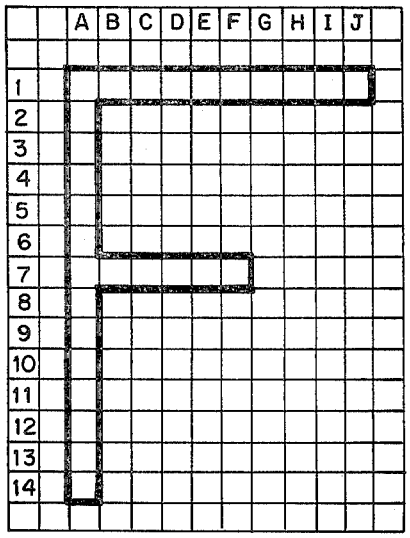
FIG. 1 is an illustration of an exemplative character provided by a well-known digital character generator.

With a proper configuration of "1"s and "0"s, a representation of a character may be built up over several scan lines. A typical representation of the digitally generated character "F" is shown in FIG. 1. In this Figure, horizontal scans are represented by horizontal lines and pixels are represented by the boxes along each scan line. The character is generated by scanning sequentially from top to bottom and from left to right. Specifically, the cathode ray tube beam starts first on line 1 and sweeps from position A to position B, et cetera. After reaching the end of the line, in response to the horizontal sync. pulse, the beam returns to the lefthand portion of the page and sweeps line 2, starting in position A proceeding to position B and the remaining positions. The sweep speed of a typical monitor is high enough and the persistence of the phosphor on the display screen is sufficient so that after fourteen scans the character as shown in FIG. 1 appears to the eye.

Figure 2:
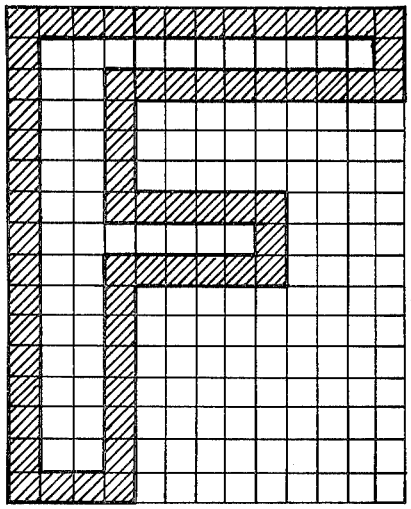
FIG. 2 shows a composite video character with a desired all-around edge mode of character enhancement.

An example of an enhanced character which is generated by the illustrative embodiment of the present invention is shown in FIG. 2. This character is equivalent to that shown in FIG. 1 except that the vertical portions of the character body have been expanded by one pixel and the entire character has been "edged" by a black signal which is one pixel wide.

Figure 3:
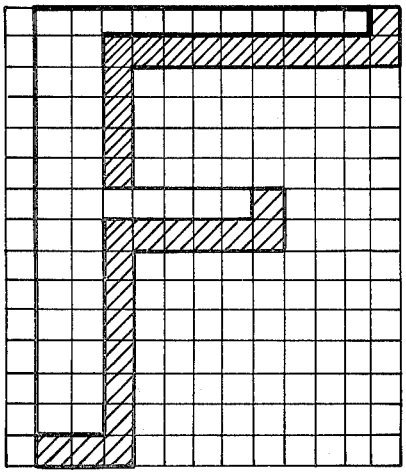
FIG. 3 shows a similar character with a "drop shadow" mode of character enhancement.

Another version of an enhanced character generated by the illustrative embodiment of the present invention is shown in FIG. 3. This arrangement is known as a "drop shadow" arrangement in which the vertical portions of the character body shown in FIG. 1 have been increased by one interval and black "edging" information is provided on only the bottom and right-hand edges of the character.

Figure 4:
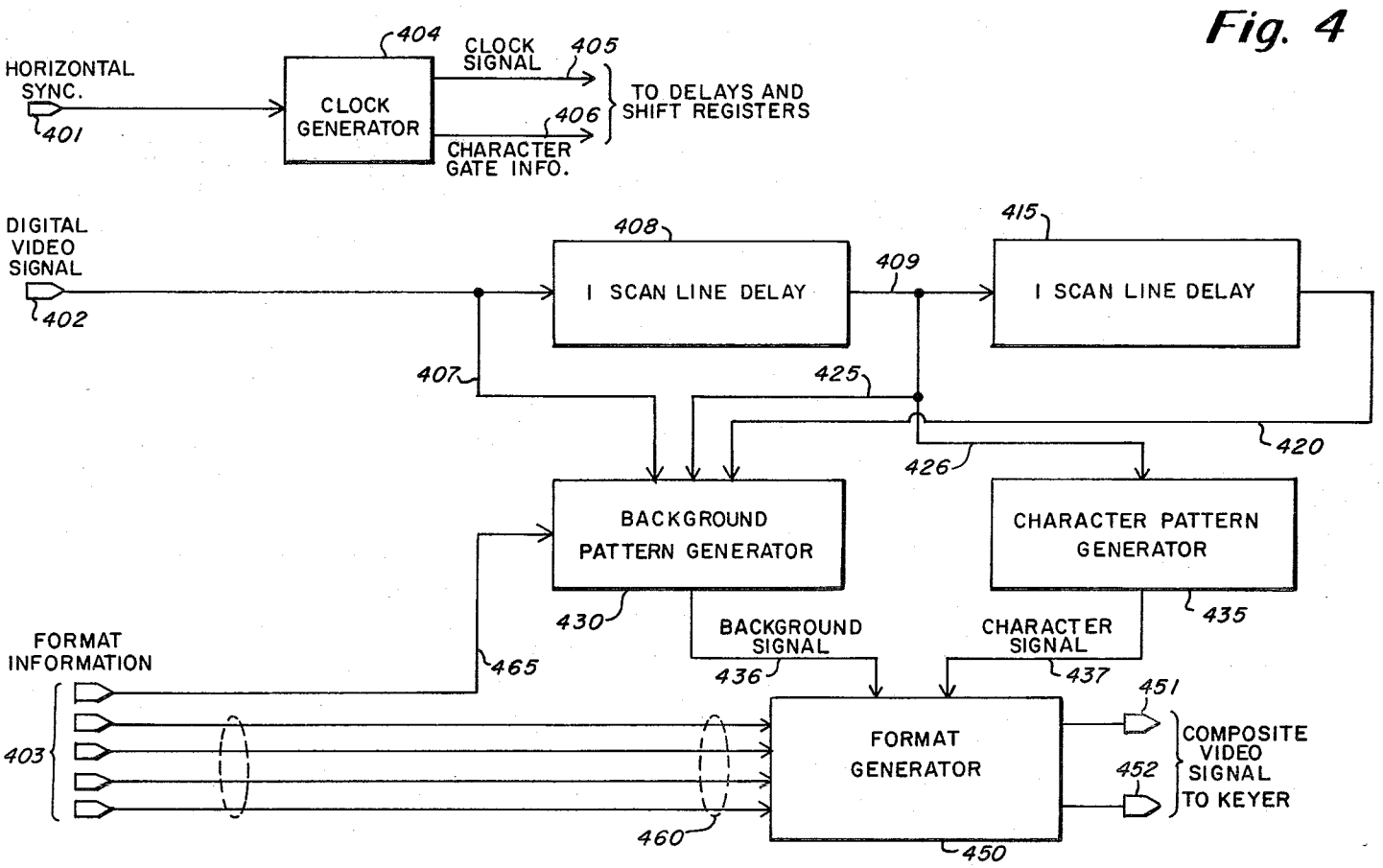
FIG. 4 shows a block diagram of an illustrative embodiment of the inventive character generator.

FIG. 4 of the drawing shows a block diagram of the illustrative apparatus which is capable of producing the enhanced characters shown in FIGS. 2 and 3. The apparatus receives a number of signals from the digital display system and from utilization devices, which signals synchronize and select the output format generated by the apparatus. These input signals are shown at the left-hand side of the Figure.

In particular, a horizontal sync. signal utilized to synchronize the entire operation of the display system is provided on terminal 401. This signal is received by clock generator 404. Generator 404 provides a number of clocking signals which are used to regulate and control the operation of the apparatus. In particular, generator 404 may comprise a clock oscillator which oscillates at high frequencies, typically approximately 5.95 megahertz. The oscillator is synchronized to the rest of the system by the horizontal synch. pulse as is well-known in the art. The clock signals produced by the oscillator are used to operate digital delay circuits and shift registers as will be hereinafter explained. In addition, the clock generator provides character gating information which indicates the start of character information and the end of the character information on each scan line. As will be hereinafter explained, the clock signal on lead 405 and the character gating information on lead 407 is provided to the delay circuits 408 and 415 and the pattern generators 430 and 435 in order to produce the composite video signal. The clock generation circuits are well-known in the art and will not be discussed further herein.

Digitized character information generated by a well-known character generator is provided to the apparatus on terminal 402. The incoming signal on terminal 402 is provided to a scan line delay circuit 408. Delay circuit 408 delays the incoming video information so that, on its output 409, an exact replica of the incoming information appears delayed by a time interval equal to the time taken for one scan line on the video display screen.

The output of scan line delay 408 is provided, via lead 409, to a second scan line delay 415 and to the background pattern generator and the character body generator 435, via leads 425 and 426, respectively. The output of delay 415 is a replica of the incoming video information delayed by a time interval equal to the time required to scan two lines. This information is provided to the background pattern generator 430 via lead 420.

In addition to delayed video information from delays 408 and 415, background pattern generator 430 also receives the incoming video signal from terminal 402 via lead 407 and format information from terminals 403 via lead 465. Generators 430 and 435 produce a background signal on lead 436 and a character signal on lead 437 respectively. These two signals are, in turn, provided to the format generator 450. In response to these signals and format information received from terminals 403 (which may be provided, via terminal 403, by means of switches, computer programs or other control means), format generator 450 determines which of the enhanced characters (shown in FIGS. 2 and 3) will be generated by the apparatus and whether the enhanced character will appear on the video display screen as a "white" character with "black" edging or a "black" character with "white" edging or some other combination as will be hereinafter described.

The composite video information generated by format generator 450 is provided on terminals 451 and 452 as "black" and "white" signals to a video keyer. The video keyer is a well-known apparatus which inserts the two video signals into the final video output signal to generate the desired character display.

In accordance with the invention, background pattern generator 430 begins producing a first predetermined output signal whenever the left edge of a character is detected as indicated by the presence of character information on three of its input leads 407, 425 and 420. Generator 430 produces a second predetermined output signal when the right edge of a character is detected as indicated by the absence of character information on its input leads. Character body generator 435, however, produces a delayed version of the signal on its input 426.

The two signals present on output leads 436 and 437 are combined by the format generator to produce the appropriate enhanced character signal.

Figure 5:
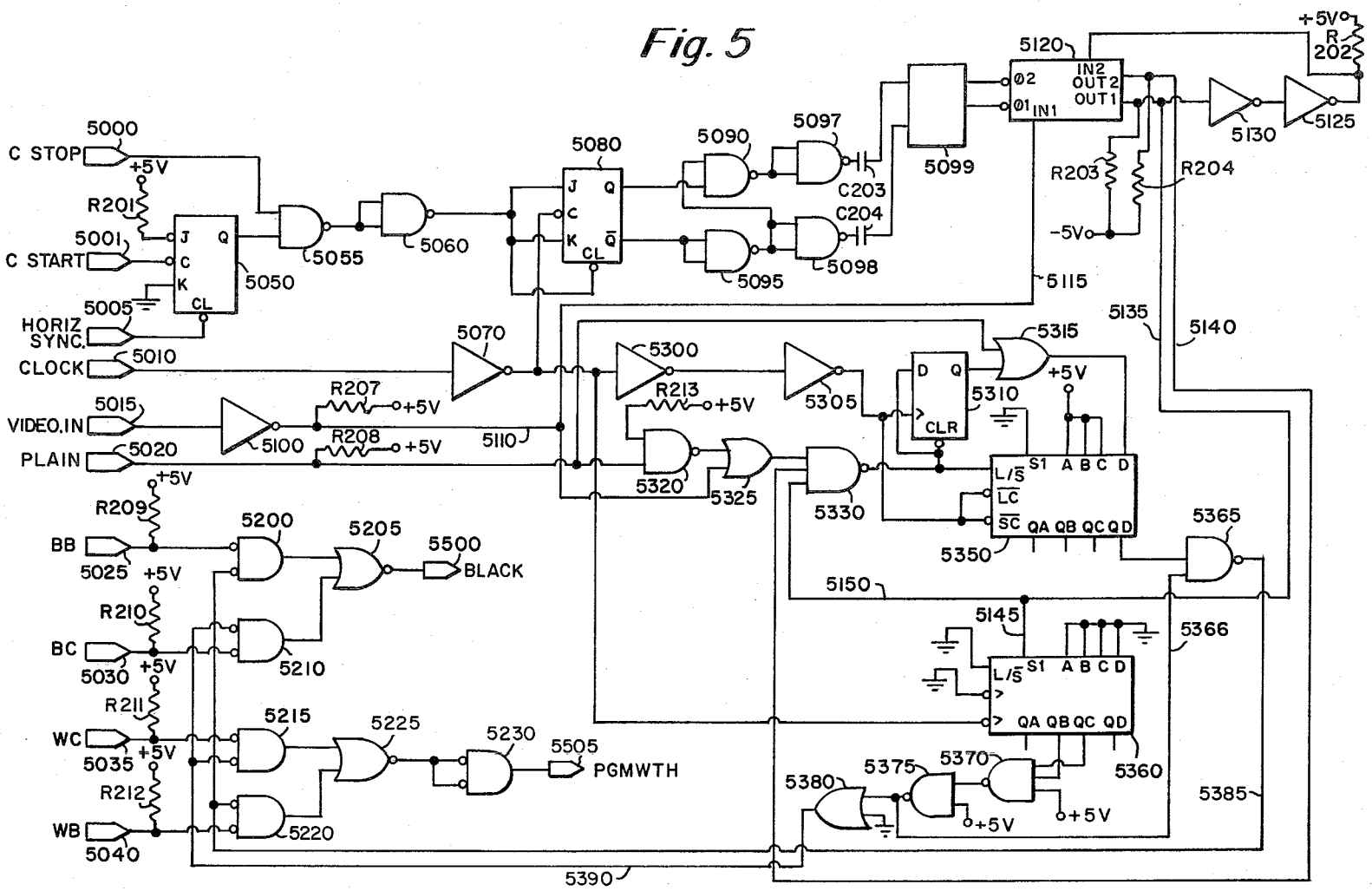
FIG. 5 is a detailed schematic of an illustrative embodiment of the character generator.

A detailed schematic diagram of an illustrative embodiment of the invention is shown in FIG. 5. As previously described, the character generator apparatus receives a number of inputs from the clock generator circuitry. In particular, two signals are provided on terminals 5000 and 5001 indicating for each scan line the start of a character interval and the stop of a character interval, a horizontal sync. pulse is provided on terminal 5005 and a 5.95 megahertz clock signal is provided on terminal 5010.

Specifically, the horizontal sync. pulse on terminal 5005 is "high" during each scan line interval and "low" during the time that the scanning beam is being returned to its starting position. The synch. signal appears as shown in line A of FIG. 7. The 5.95 megahertz clock signal appearing on terminal 5010 is as shown in line B of FIG. 7. The character start signal appearing on terminal 5001 is "low" during the "low" portion of the horizontal sync. pulse and becomes "high" approximately sixteen clock pulses after the horizontal sync pulse becomes "high" as shown in line C of FIG. 7. The character stop pulse, on the other hand, becomes "high" on the falling edge of the horizontal sync. pulse, remains "high" for exactly 256 clock counts (equalling 256 pixels on each scan line) and it then becomes "low" until the falling edge of the next horizontal sync pulse as shown in line D of FIG. 7.

Other inputs are also supplied-the input digital video signal is provided on terminal 5050 and format selection signals are provided on terminals 5020–5040, respectively.

Figure 7:
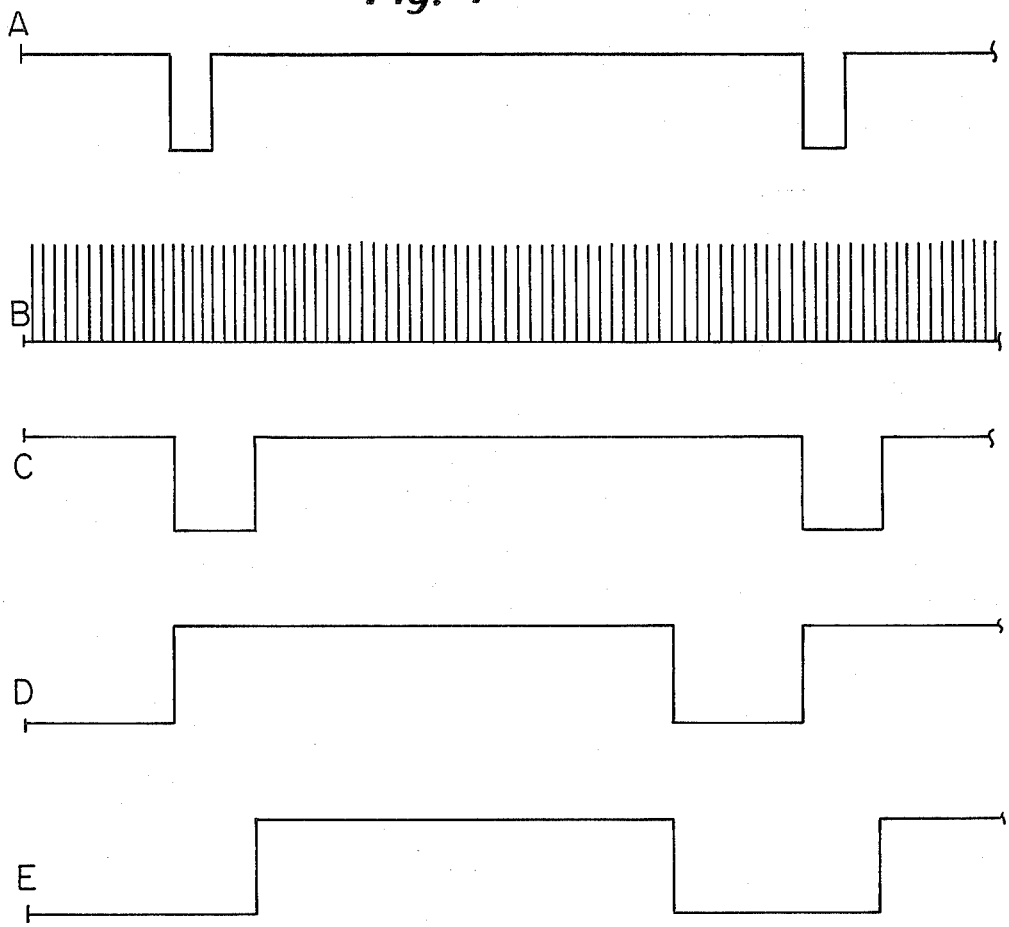
FIG. 7 is a waveform diagram showing the timing waveforms generated and utilized by the circuit in FIG. 5.

The clock signals appearing on terminals 5000 through 5010 are applied to clocking circuitry consisting of flip-flop 5050, gates 5055 and 5060 and flip-flop 5080. The character start pulse on terminal 5001 is applied to the clock input of JK flip-flop 5050. Since flip-flop 5050 has its J input connected to a logical "1" (positive 5 volts by resistor R201) and its K input grounded, on the falling edge of the start signal the Q output of flip-flop 5050 becomes "high" and remains "high" until the flip-flop is reset when the horizontal sync. signal on terminal 5055 applied to the clear input of flip flop 5050 becomes "low." This signal is combined by ANDgate 5055 with the character stop signal provided on lead 5000. The output of gate 5055 is therefore a signal which becomes "high" approximately 16 clock counts after the rising edge of the horizontal sync. pulse and remains "high" for 256 clock counts as shown in FIG. 7, line E. This signal is inverted by inverter 5060 and applied to the J, K and clear inputs of flip-flop 5080. When this signal is "high" the J and K inputs of flip-flop 5080 are "high" and thus the flip-flop toggles on the negative edge of each clock pulse provided to its clock input by the output of buffer inverter 5070, which is, in turn, driven by the 5.95 megahertz clock signal on terminal 5010. Its ouputs Q and Q therefore provide a two-phase driving signal at a frequency of one-half of the clock signal. The outputs of flip-flop 5080 are provided to cross-coupled gates 5090 and 5095 which ensure that both inputs to driver circuit 5099 are not positive at the same time. The outputs of gates 5090 and 5095 are, in turn, provided to driver gates 5097 and 5098. These gates provide pulses, via capacitors C203 and C204, to high-current driver circuit 5099. Driver circuit 5099, in turn, drives the digital delay circuit 5120.

Delay circuit 5120 is a well-known digital device which includes two 256-bit delays. It constitutes the delay circuits designated as delays 408 and 415 in FIG. 4. A signal present on the IN1 input appears on the OUT1 output 256 clock pulses later. The OUT1 output is normally held "low" by resistor R203 connected to a negative five volt supply. However, a "high" signal provided to its input causes output OUT1 to go "high" 256 clock pulses later. A "high" signal at output OUT1 drives buffer gates 5125 and 5130 which provide an input to the IN2 input. Signals appearing at the IN2 input appear at the OUT2 output 256 clock pulses later.

The incoming digital video signal on terminal 5015 is inverted by buffer inverter 5100 and applied, via leads 5110 and 5115, to the IN1 input of delay circuit 5120. Therefore, delayed versions of the video signal appear, on lead 5135, delayed by one scan line and, on lead 5140, delayed by two scan lines. These two signals together with the incoming video signal on lead 5110 are provided to the pattern generation circuitry consisting of shift registers 5350 and 5360 as will be hereinafter described to generate the background and character body patterns.

In particular, the input video signal appearing on terminal 5015 is inverted by inverter 5100 and applied to lead 5110. Therefore, video information indicating the presence of video characters (which appears as digital "1" signals at terminal 5015) appears as "0"s on lead 5110. The signals on lead 5110 are applied to the lower input of ORgate 5325. The upper input of ORgate 5325 is controlled by NANDgate 5320 which is, in turn, controlled by format information provided to the circuitry, via terminal 5020. The operation of NANDgate 5320 in controlling the format of the generated characters will be described in detail below.

Assume for the moment that NANDgate 5320 provides a "low" signal to ORgate 5325. In this case, ORgate 5325 produces a "low" signal when video information indicative of the presence of a character appears on lead 5110. The output of ORgate 5325 is, in turn, provided to the upper input of NANDgate 5330. The other two inpus of NANDgate 5330 are delayed video signals appearing on leads 5135 and 5140, respectively. Therefore, NANDgate 5330 produces a "high" signal when video information, indicating the presence of a character appears on the incoming video line 5110, or either of the delay outputs of the delay circuit 5120. The output of NANDgate 5330 is used as a control signal to cause the background pattern generator to generate two fixed patterns of digital signals which are used to generate background information.

Specifically, the output of NANDgate 5330 is provided to the load/shift input of shift register 5350. Register 5350 acts as the background pattern generator and produces a "one" on its output when it detects the left-hand edge of a character. The left-hand edge of a character is detcted by detecting the presence of video information on the incoming video line, or either of the outputs of delay circuit 5120, as indicated by a "high" output of NANDgate 5330. In particular, in accordance with the well-known operation of digital shift registers, register 5350 "loads" the digital signals appearing at its inputs A, B, C and D when the signal appearing at the load/shift input is "high." Inputs A, B and C are connected to logical "1" ("high" voltage). Assume for the moment that input D of register 5350 is also held "high"

by the output of ORgate 5315. Thus, when the output of NANDgate 5330 changes from a "low" signal to a "high" signal, (indicating the lefthand edge of a character), four "1"s are loaded into register 5350 and appear on the outputs QA through QD. During the loading operation shifting of the register is inhibited. Therefore, each occurence of character information (beginning with the lefthand edge of the character) produces a "loading" operation that, in turn, produces a "1" at the QD output of register 5350.

Figure 6A:
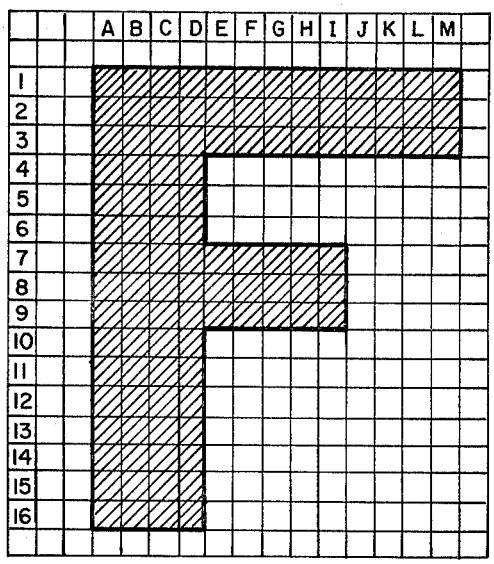
FIG. 6A shows the background signals produced by the illustrative embodiment.
Figure 6B:
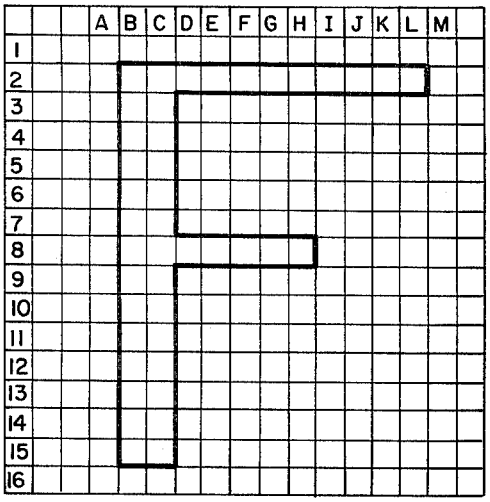
FIG. 6B shows the character signals produced by the illustrative embodiment.

The operation of register 5350 in producing the background pattern can most easily be explained by separating a composite video character into its background information and its character information. For example, the composite character shown in FIG. 2 can be separated into background information, as shown in FIG. 6A, and character information, as shown in FIG. 6B. The background pattern in FIG. 6A is produced when the video information, as shown in FIG. 1, is provided, via terminal 5015, to the register 5350 and associated gates.

In particular, line 1 of the background pattern, FIG. 6A, is produced when line 1 of the incoming digital information is provided, via lead 5110 and ORgate 5325, to NANDgate 5330. As previously mentioned, register 5350 provides a "high" signal on its QD output for each video character bit detected by gate 5330. Therefore, pixels A–J of the background pattern in FIG. 6A are generated by the information in pixels A–J in FIG. 1.

As shown in FIG. 1, after pixel J, at the righthand edge of the character, the incoming video information becomes "low" since no character information is present. The "high" to "low" transition at the righthand edge of the character causes NANDgate 5330 to apply a "high" to "low" signal transition to the load/shift input of register 5350. In response to the "low" signal register 5350 begins shifting. Since all of its stages has previously been set to "1"s during the loading operation, and since the shift input S1 is connected to logical "0," a fixed pattern consisting of exactly three additional "1"s are shifted through output QD followed by "0"s. Thus, the first line of FIG. 1 results in the first line in FIG. 6A which consists of ten "high" outputs followed by three additional "high" outputs.

The second line of the background information, shown in FIG. 6A as line 2, is generated by the delayed input from line 1 appearing at the output of the digital delay circuit on lead 5135 and provided to NANDgate 5330. The delayed video information causes NANDgate 5330 to produce a background pattern exactly the same as the incoming information except that it has been delayed one scan line in time and thus the second line of FIG. 6A resembles the first. The incoming video information on lead 5110 also is provided to NANDgate 5350, but the output of gate 5350 is governed by the longest block of character information present on any of leads 5110, 5135 or 5140, which in this case is the character information block which appears on lead 5135 (the delayed version of the first character line which is ten pixels long as compared to the incoming video information which is one pixel long).

Similarly, the third line resembles the first and second due to the twice delayed input appearing at output OUT2 of the digital delay circuit.

Thus, each horizontal line of the character will result in three lines of the background character which are arranged vertically, having a width which is three pixels longer than the width of the longest of the incoming video line, the previous line (delayed for one scan line) or the second previous line (delayed for two scan lines). Each vertical character section will appear expanded by three scan intervals due to the shifting action of register 5350. Thus, the composite background character shown in FIG. 6A results when the digital information shown in FIG. 1 passes through the character generator system.

The character body information is generated by shift register 5360. In particular, the output of the first digital delay circuit on lead 5135 is provided via lead 5145 to the shift input S1 of register 5360, and register 5360 is driven from the clock as register 5350, via inverter 5070. Thus, any input appearing on input S1 appears sequentially in time at the outputs QA through QD of register 5360. With no video signal present, the output of the delay circuit 5120 is "high" and thus "high" signals appearing on lead 5145 are shifted through register 5360. When a "low" signal, indicative of a digital character, appears at the S1 input of register 5360 the signal is shifted through the register one stage at a time in response to each clock pulse. Since the output QA of register 5360 is not connected to the circuitry, the information is delayed by one pixel. Information present at either of register 5360 outputs QB or QC causes NANDgate 5370 to provide a "high" output. Due to the delay and the operation of NANDgate 5370, the output of NANDgate 5370 becomes "high" one pixel after video information appears at the output of the delay circuit and remains "high" for two pixels. The output of register 5360 therefore is the character body information, as shown in FIG. 6B. The character body output is delayed one scan line due to the operation of delay circuit 5120. In addition, the vertical sections are expanded by one pixel because of the "ORing" action of NANDgate 5370. In addition, character body output is delayed one pixel due to the delay action of register 5360.

In order to produce the complete composite character signal the background and character body signals are ANDed together. Specifically, the output QD of register 5350 is applied to the upper input of NANDgate 5365. The lower input of gate 5365 receives a output from NANDgate 5375 which acts as an inverter. Gate 5375 is in turn driven by the output of NANDgate 5370, the output of the character body generator. When the output of NANDgate 5370 becomes "high," indicating a character body signal, it is inverted by inverter 5375 and applied as a "low" signal to ORgate 5380 which is used to equalize propagation delays to insure that the background signals and character body signals are properly synchronized. Responsive to a "low" signal at its input, gate 5380 applies a "low" signal to gate 5365, to disable it. Therefore, whenever character information is present, background information produced at the output QD of register 5350 is inhibited. Thus, the output of NAND gate 5365 is shown in the shaded portions of FIG. 6C.

Figure 6C:
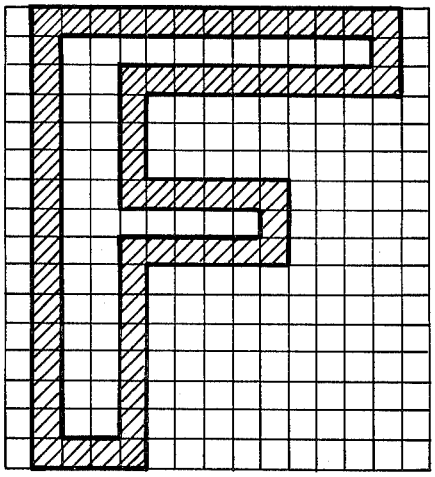
FIG. 6C shows the composite signals produced by the illustrative embodiment.

A comparison of FIG. 6B and 6C will show that these are the signals necessary to generate the composite character shown in FIG. 2. These signals are present on leads 5390 and 5385, respectively, and are provided to gates 5200, 5210, 5215, and 5220. These gates receive four formatting signals from terminals 5025, 5030, 5035 and 5040 respectively. The four formatting signals determine whether background signals are provided to the black keying output 5550 and character body signals are provided to the white keying output 5505 or vice versa. These gates allow the utilization circuitry to decide the exact format of the output character according to the following table:

| | WC | WB | BC | BB | PLAIN |
|---|---|---|---|---|---|
| White character only | 0 | 1 | 1 | 1 | 1 |
| Black character only | 1 | 1 | 0 | 1 | 1 |
| White edge only | 1 | 0 | 1 | 1 | 1 |
| Black edge only | 1 | 1 | 1 | 0 | 1 |
| White character with black edge | 0 | 1 | 1 | 0 | 1 |
| Black character with white edge | 1 | 0 | 0 | 1 | 1 |
| White character with black drop shadow | 0 | 1 | 1 | 0 | 0 |
| Black character with white drop shadow | 1 | 0 | 0 | 1 | 0 |

The format signal appearing at terminal 5020 is used to choose between the full edge and drop shadow output shown in FIGS. 2 and 3, respectively. During normal operation the signal appearing at terminal 5020 is "high" and the lower input of NANDgate 5320 is pulled "high" by resistor R208 which is connected to positive 5 volts. The upper input of NANDgate 5320 is also connected to positive 5 volts by resistor R213. Thus, both inputs of NANDgate 5320 are "high" causing it to produce a "low" output signal which is provided to ORgate 5325. The circuit then operates to generate the characters shown in FIG. 2, as previously described.

When, however, a "low" signal is present on input terminal 5020, indicating that a "drop shadow" character is desired, NANDgate 5320 provides a "high" signal to ORgate 5325. The "high" signal effectively disables ORgate 5325, thereby preventing the incoming video information from generating the first background line (for example, line 1 and 7 in FIG. 6A).

In addition, the "low" signal on terminal 5020 is applied to the upper input of ORgate 5315. The lower input of gate 5315 is connected to the Q output of flip-flop 5310. When no video information is present at the inputs of NANDgate 5330, the "low" signal at its output clears flip-flop 5310 and thus its Q output is "low." Thus when no video information is present, ORgate 5315 receives "low" signals at both of its inputs and, in turn, produces a "low" signal which is applied to the D input of background pattern generating register 5350. Accordingly, when the lefthand edge of the character, corresponding to the first bit of video character information is detected by gate 5330, the first output signal produced by the register on its output QD is a "0" producing no background information.

The "high" signal produced as previously described at the output of NANDgate 5330 in response to the first bit of video information removes the clearing signal from flip-flop 5315 and applies a "high" signal to its D input. Therefore, on the next clock pulse, flip-flop 5310 becomes set and produces a "high" signal at its Q output which "high" signal is provided to the lower input of ORgate 5215, in turn, causing it to produce a "high" signal on its output. This "high" signal replaces the "low" signal previously applied to the D input of character generator 5350. Therefore, after the first video character is detected, register 5350 produces "high" signals during each scan interval during which a character is detected plus three additional scan intervals. The inhibition caused by OR gate 5315 inhibits the signals generated in the leftmost column in FIG. 6A, thereby removing the edging from the character shown in FIG. 2 and producing the character shown in FIG. 3.

An examinaton of the operation of the system will show that each horizontal line of the generator character is produced by an output of the digital delay circuits. Similarly, each column of the character is produced by one stage of shift registers 5350 and 5360. Thus, in order to change the dimensions of the character it is necessary to only add additional delays with corresponding inputs on NANDgate 5330 or to increase the number of stages of shift registers 5350 and 5360. It is not necessary to rewire the system or increase the number of shift registers no matter how wide or how tall a character is desired. Thus, the illustrative embodiment provides the greatest flexibility while maintaining a minimum number of parts.

While the foregoing description and drawings represent the preferred embodiments of the present invention it will be obvious to those skilled in the art that various changes and modifications may be made therein without departing from the true spirit and scope of the present invention.

What is claimed is:

1. In display enhancement apparatus for use in a video display system having circuitry for producing digital signals having first and second values representative of a video character, said apparatus having at least one delay means for generating delayed signals which are equivalent to said signals delayed by a time interval equal to the time duration of one horizontal scan line and a clock signal generator for generating clocking signals in synchronism with said digital signals, the improvement comprising, gate means responsive to said digital signals and said delayed signals comprising said character for producing an output when said signals have said first value, a parallel-loading shift register responsive to said output for loading a predetermined pattern of digital information into each stage of said register, and responsive to said clocking signals for shifting said predetermined pattern through said register stages, and means responsive to the digital information stored in one of said shift register stages for generating a background signal output.

2. In display enhancment apparatus, the improvement according to claim 1 wherein one of said shift register stages has an output for producing a signal equivalent to the information stored in said one stage and the improvement further comprises, pattern generating means responsive to said signal and said delayed signal for producing a character body signal, and means responsive to the signal at said shift register output and said character body signal for generating a composite video signal output.

3. Display enhancement apparatus for use in a video display system having circuitry for producing digital signals representative of a video character and clock signal generation circuitry, said apparatus comprising at least two delay means for generating delayed signals which are equivalent to said signals delayed by a time interval equal to the time duration of one horizontal scan line and twice-delayed signals which are equivalent to said signals delayed by a time interval equal to the time duration of two horizontal scan lines, gate means responsive to digital character information in said signal, said delayed signal and said twice-delayed signal for producing a first output and responsive to the absence of character information in said signal, said delayed signal and said twice-delayed signal for producing a second output, a parallel-loading shift register responsive to said first output for loading a predetermined pattern of digital information into each stage of said register, and responsive to said second output and said clock signals for shifting said predetermined pattern through said register stages, one of said shift register stages having an output for producing a signal equivalent to the information stored in said one stage, pattern generating means responsive to said signals and said delayed signals for producing a character body signal, and means responsive to the signal at said shift register output and said character body signal for generating a composite video signal output.

4. Display enhancement apparatus according to claim 3 further comprising means to vary said predetermined pattern of digital information loaded into said parallel-loading shift register in accordance with the desired character type.

5. Display enhancement apparatus according to claim 4 wherein said pattern generating means comprises, a shift register having at least a first second and third stage connected in serial order and an input, means for providing said delayed signals to the input of said shift register, and means for generating a character body signal when digital character information appears in said second shift register stage.

6. Display enhancement apparatus according to claim 5 wherein said gate means is an OR gate having a plurality of inputs and an output, each of said OR gate inputs being connected to the output of one of said delay means.

7. Display enhancement apparatus for use in a video display system having circuitry for producing digital signals having a first value representative of a video character body and a second value representative of background information and clock signal generation circuitry, said apparatus comprising a first digital delay circuit having an input for receiving said digital signals and an output for generating delayed signals which are equivalent to said signals delayed by a time interval equal to the time duration of one horizontal scan line, a second digital delay circuit having an input connected to the output of said first delay circuit and an output for generating twice-delayed signals which are equivalent to said signals delayed by a time interval equal to the time duration of two horizontal scan lines, a first NAND gate having three inputs and an output, one of said first NAND gate inputs being connected to said display system for receiving said digital signals, a second of said first NAND gate inputs being connected to the output of said first delay circuit and a third one of said first NAND gate inputs being connected to the output of said second delay circuit, a parallel-loading shift register having at least a first, a second and a third stage connected in serial order, an input, a load/shift control input and a clock input, said shift register input being connected to a digital signal source having said second value, said load/shift control input being connected to said output of said first NAND gate and said clock input being connected to said display system for receiving said clock signals, pattern generating means responsive to said signals and said delayed signals for producing a character body signal, and a second NAND gate having two inputs and an output, one of said second NAND gate inputs being connected to said shift register third stage and the other of said second NAND gate inputs being connected to said pattern generating means.

8. Display enhancement apparatus according to claim 7 further comprising means to vary said predetermined pattern of digital information loaded into said parallel-loading shift register in accordance with the desired character type.

9. Display enhancement apparatus according to claim 8 wherein said varying means comprises means for generating a digital signal having a first value for one clock period and an OR gate having two inputs and an output, one of said OR gate inputs being connected to said display system for receiving said digital signals, the other of said OR gate inputs being connected to said generating means and said OR gate output being connected to the parallel load input of said third shift register stage.

10. Display enhancement apparatus according to claim 9 wherein said pattern generating means comprises, a shift register having at least a first second and third stage connected in serial order and an input, means for providing said delayed signals to the input of said shift register, and means for generating a character body signal when digital character information appears in said second shift register stage.

* * * * *